US005692928A

United States Patent [19]

Nelson et al.

[11] Patent Number: 5,692,928

[45] Date of Patent: Dec. 2, 1997

[54] ELECTRICAL CONNECTOR HAVING TERMINALS WITH IMPROVED RETENTION MEANS

[75] Inventors: Richard A. Nelson, Geneva; Michael O'Sullivan, Willowbrook, both of Ill.

[73] Assignee: Molex Incorporated, Lisle, Ill.

[21] Appl. No.: 645,542

[22] Filed: May 10, 1996

[51] Int. Cl.[6] ..... H01R 13/41

[52] U.S. Cl. ..... 439/733.1; 439/884

[58] Field of Search ..... 439/733.1, 741, 439/743, 884, 869, 870

[56] References Cited

U.S. PATENT DOCUMENTS

| | | | |
|---|---|---|---|
| 3,178,672 | 4/1965 | Batcheller | 439/870 |
| 3,281,760 | 10/1966 | Oshima et al. | 339/176 |
| 3,530,422 | 9/1970 | Goodman | 439/733.1 |
| 3,579,178 | 5/1971 | Travis | 439/733.1 |
| 3,588,862 | 6/1971 | Brizzi | 339/258 |
| 3,833,879 | 9/1974 | Aidn et al. | 439/741 |
| 3,865,462 | 2/1975 | Cobaugh et al. | 339/176 |
| 4,175,821 | 11/1979 | Hunter | 339/258 |
| 4,186,982 | 2/1980 | Cobaugh et al. | 339/17 |
| 4,241,970 | 12/1980 | Rider, Jr. et al. | 339/99 |
| 4,324,451 | 4/1982 | Ammon et al. | 339/176 |
| 4,429,459 | 2/1984 | Lynch | 29/881 |
| 4,583,805 | 4/1986 | Mantlik | 339/61 |
| 4,591,230 | 5/1986 | Roldan | 339/256 |
| 4,607,907 | 8/1986 | Bogursky | 339/258 |
| 4,660,915 | 4/1987 | Mantlik | 339/61 |
| 4,679,890 | 7/1987 | Fineblum | 439/884 |
| 4,740,180 | 4/1988 | Harwath et al. | 439/830 |
| 4,820,182 | 4/1989 | Harwath et al. | 439/290 |
| 4,842,528 | 6/1989 | Frantz | 439/80 |
| 4,887,976 | 12/1989 | Bennett et al. | 439/492 |
| 5,030,138 | 7/1991 | Capp et al. | 439/92 |
| 5,064,391 | 11/1991 | Buchter | 439/733 |
| 5,112,233 | 5/1992 | Lybrand | 439/79 |
| 5,190,483 | 3/1993 | Viselli | 439/751 |
| 5,290,181 | 3/1994 | Bixler et al. | 439/856 |

FOREIGN PATENT DOCUMENTS

| | | | |
|---|---|---|---|
| 0 288 248 B1 | 4/1988 | European Pat. Off. . | |
| 0 638 960 A2 | 7/1994 | European Pat. Off. . | |
| 0 647 986 A1 | 9/1994 | European Pat. Off. . | |
| 1340607 | 12/1962 | France . | |
| 146271/85 | 9/1991 | Japan . | |
| 663684 | 12/1951 | United Kingdom | 439/870 |

*Primary Examiner*—Gary F. Paumen

*Attorney, Agent, or Firm*—Charles S. Cohen

[57] ABSTRACT

A male electrical terminal includes an elongated planar body portion, a terminating portion extending rearwardly of the body portion and a contact portion extending forwardly of the body portion. The body portion includes an enlarged retention section that is twisted relative to the plane of the body portion. An electrical connector includes a housing with terminal-receiving passages each including opposing side walls for embracing opposite sides of the body portion of a respective one of the terminals. Each passage also includes an oblique portion intersecting the opposing side walls for embracing the twisted retention section of the respective terminal.

17 Claims, 3 Drawing Sheets

FIG.4

ELECTRICAL CONNECTOR HAVING TERMINALS WITH IMPROVED RETENTION MEANS

FIELD OF THE INVENTION

This invention generally relates to the art of electrical connectors and, particularly, to an improved retention means or system for holding terminals in a connector housing.

BACKGROUND OF THE INVENTION

A known type of input/output (I/O) electrical connector includes a dielectric housing having a front mating face and a rear face with a terminal-receiving cavity extending therebetween. A plurality of terminals are mounted in the housing, with portions of the terminals, such as male pin portions, extending outwardly of the dielectric housing for mating with the female terminals of a complementary mating connector. Often, the cavity in the housing comprises a plurality of terminal-receiving passages extending between the front mating face and the rear face of the housing. Most often, the terminals have enlarged or modified body sections which are used to fix the terminals within the passages in the housing so that the projecting mating portions of the terminals are maintained in proper spacing and alignment. The terminals typically are stamped and formed of conductive sheet metal material, and the enlarged body sections often are formed by retention barbs projecting outwardly of opposite edges of the stamped metal terminal.

An I/O connector of this type is shown in U.S. Pat. No. 4,740,180 dated Apr. 26, 1988 and assigned to the assignee of the present invention. That patent discloses a low insertion force mating electrical contact structure including a male terminal having a final contact portion and a forwardly extending lead-in portion having a gradual twisted cross-section relative to the final contact portion. In a preferred embodiment, the male terminal is adapted to mate with a dual contact cantilever spring arm female terminal.

Considerable problems continue to arise in designing I/O connectors of the character described above, because of the tendency in the electronics industry to demand miniaturized connectors having ever-increasing terminal densities. Typically, the terminals are densely arranged in the dielectric connector housing, leaving only a small amount of housing material between adjacent terminals. The housings typically are molded of plastic material. Terminal retention sections, such as the outwardly projecting retention barbs described above, must be wide enough that they slightly exceed the width of the closely-spaced terminal-receiving passages in the housing, whereby the terminals are held in the housing by a press-fit, which results in transversely outwardly directed forces. In very dense terminal arrangements, this tends to crack the thin housing walls between the adjacent terminal passages or make them difficult to mold. This is especially true with male terminals which tend to twist upon insertion into the passages, such as with the male terminals in the aforementioned U.S. Pat. No. 4,740,180.

One solution to the above problems has been to insert-mold the terminals in a dielectric insert to form a terminal module which, in turn, is mounted within a cavity in the connector housing. While this might solve the retention problem, the insert-molding process adds considerably to the cost of manufacturing such miniaturized connectors.

The present invention is directed to solving the above myriad of problems by providing a retention system which better distributes the retention forces throughout the terminal array within the connector housing, and particularly a system which is highly effective with male terminals having twisted contact or lead-in ends.

SUMMARY OF THE INVENTION

An object, therefore, of the invention is to provide an electrical connector having a male terminal, of the type described above, with a new and improved terminal retention system.

In the exemplary embodiment of the invention, a male electrical terminal includes an elongated planar body portion having a terminating portion extending rearwardly therefrom. A contact portion extends forwardly of the body portion. The contact portion has a lead-in end that is gradually twisted relative to the plane of the body portion. The body portion includes an enlarged retention section that is twisted relative to the plane of the body portion such that the plane of the twisted retention section is generally coincident with the plane of the twisted lead-in end of the contact portion.

Preferably, the terminal is stamped and formed of conductive sheet metal material. The planar body portion has opposite edges, and the twisted retention section is enlarged by means of a pair of retention barbs projecting transversely outwardly from the opposite edges of the body portion. The retention barbs may have generally tapered outer edges, and the edges include teeth formed therein.

The male terminals are received in passages in a connector housing. Each passage includes opposing side walls for supporting opposite sides of the planar body portion of the terminal, and each passage includes an oblique portion intersecting the opposite side walls for passage therethrough of the twisted lead-in end of the contact portion as well as for engaging the twisted retention section.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
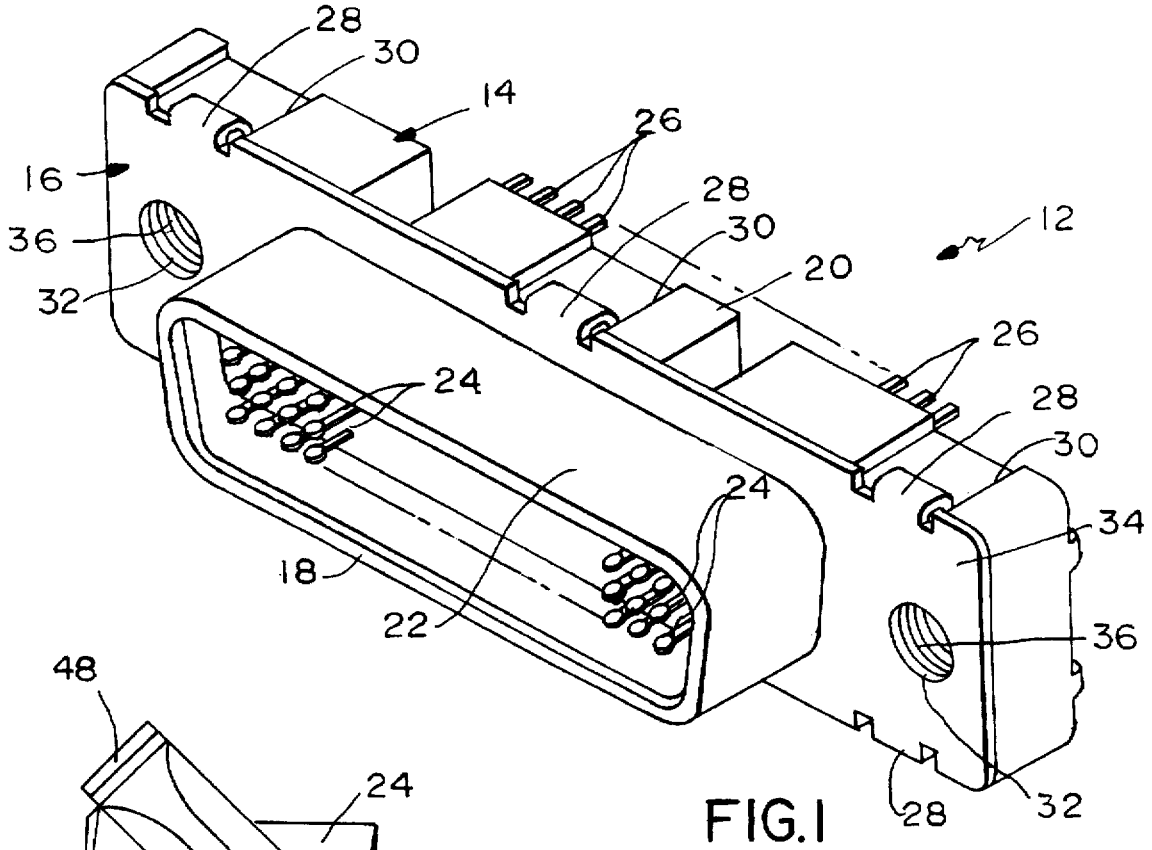
FIG. 1 is a perspective view of an electrical connector embodying the concepts of the invention.
Figure 3:
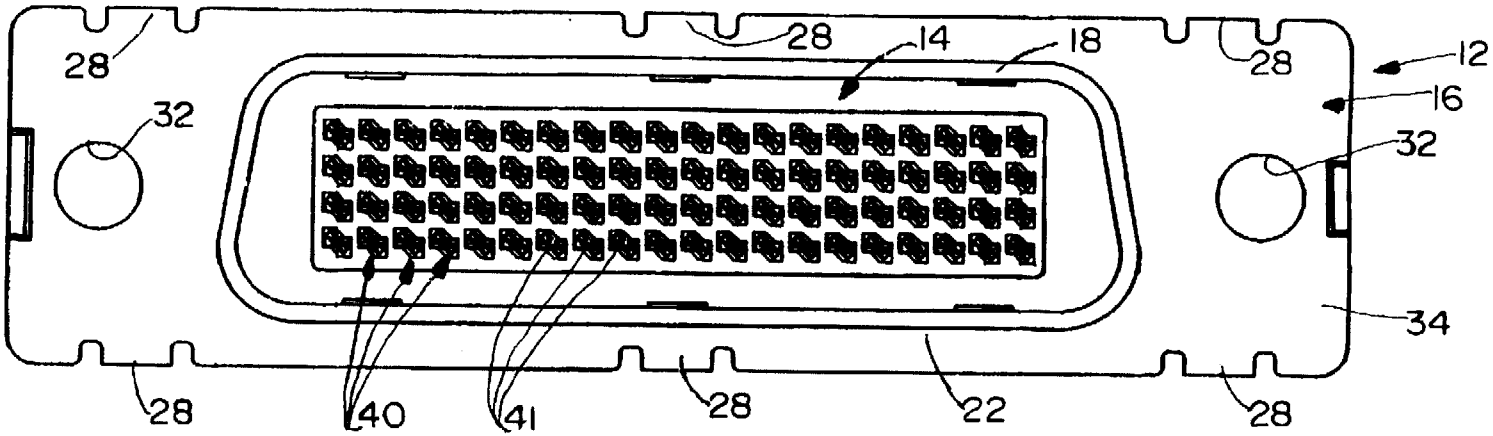
FIG. 3 is a front elevational view of the connector.
Figure 2:
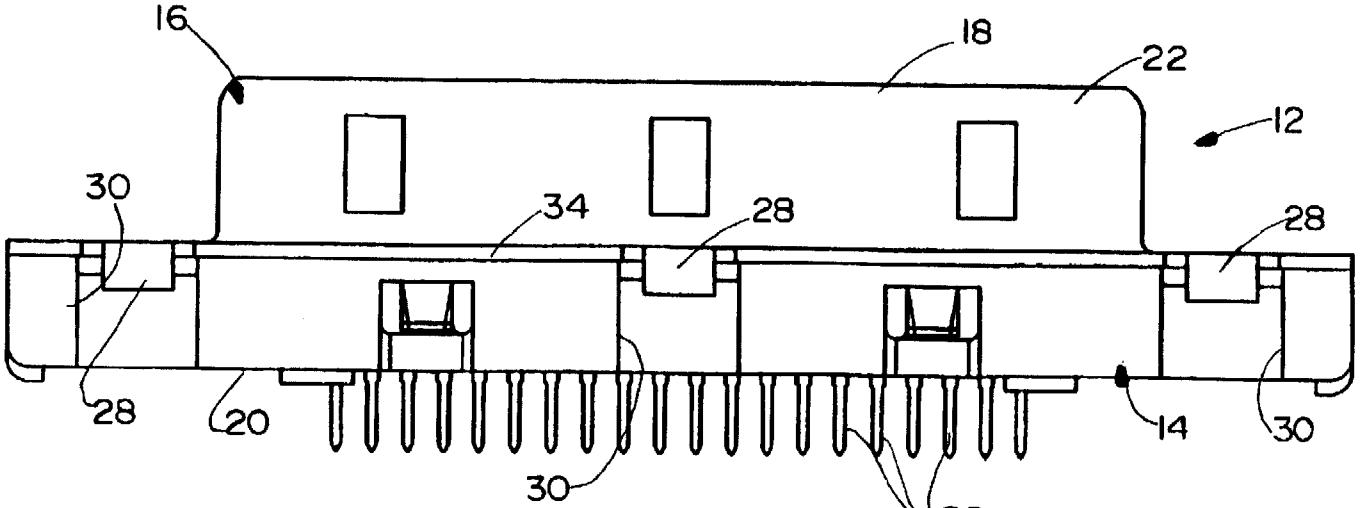
FIG. 2 is a top plan view of the connector.

Referring to the drawings in greater detail, and first to FIGS. 1–3, the invention is embodied in an electrical connector, generally designated 12, which includes an elongated dielectric housing, generally designated 14, and a front shield, generally designated 16. Housing 14 is a one-piece structure unitarily molded of dielectric material such as plastic or the like. Shield 16 is a one-piece structure stamped and formed of conductive sheet metal material.

The connector is an input/output (I/O) electrical device wherein shield 16 defines a front mating face 18 of the connector, and housing 14 defines a rear terminating face 20. The front face actually is formed by a D-shaped shroud portion 22 of the shield surrounding forwardly projecting contact portions 24 of a plurality of terminals (described hereinafter). Terminating or tail portions 26 of the terminals project from rear face 20 of the connector such as for insertion into appropriate holes in a printed circuit board for connection to circuit traces on the board and/or in the holes or for interconnection to wires of a cable.

As best seen in FIG. 1, rearwardly formed tabs 28 of shield 16 embrace housing 14 within recesses 30 thereof. Lastly, holes 32 in a base plate 34 of shield 16 are aligned with internally threaded holes 36 in inserts within the housing 14 for receiving appropriate threaded fasteners for fastening the connector to a complementary mating connector.

Figure 5:
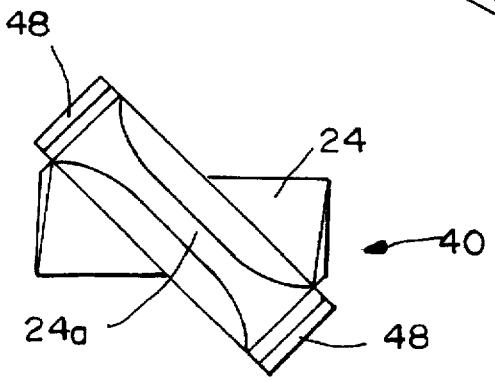
FIG. 5 is an end elevational view of the lead-in end of the terminal.
Figure 4:
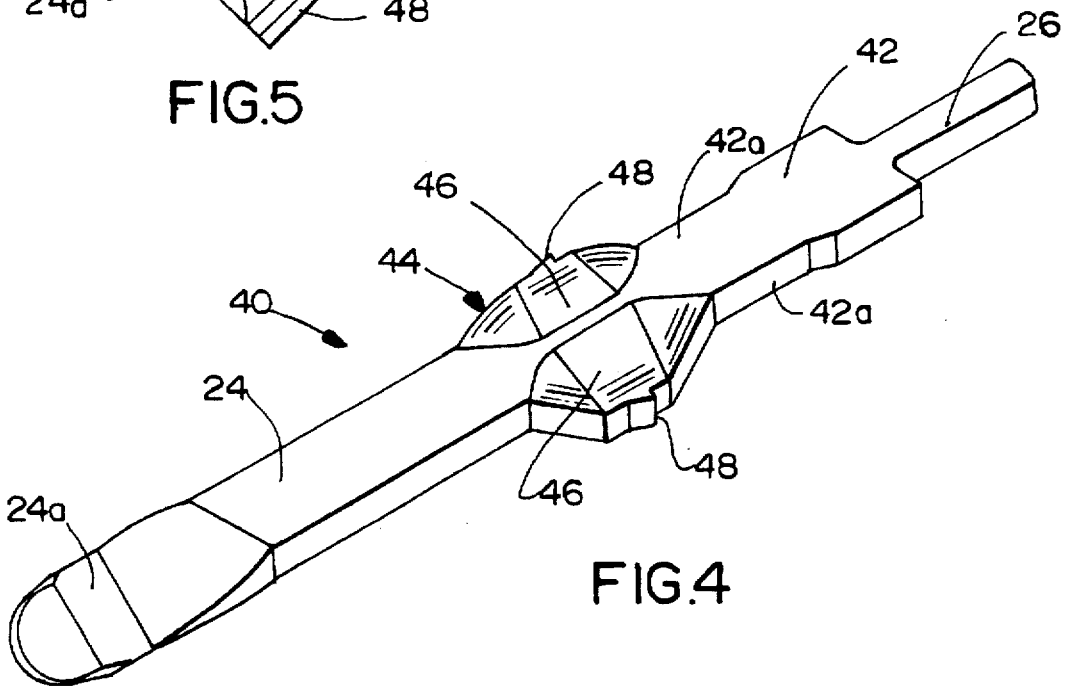
FIG. 4 is a perspective view of one of the terminals.

Referring to FIGS. 4 and 5 in conjunction with FIGS. 1–3, a plurality of male terminals, generally designated 40 (FIG. 4),.are inserted into respective ones of a plurality of terminal-receiving passages 41 in dielectric housing 14. The terminals are inserted into the passages through the rear of the connector (i.e., through rear terminating face 20 of the housing) such that contact portions 24 of the terminals project forwardly of the housing and terminating or tail portions 26 project rearwardly of the housing as described above and shown in FIG. 1.

Each male terminal 40 has an elongated generally planar body portion 42 extending between forwardly extending contact portion 24 and rearwardly extending terminating portion 26. As clearly shown in FIGS. 4 and 5, contact portion 24 has a lead-in end 24*a* that is gradually twisted relative to the plane of body portion 42. In addition, the body portion includes an enlarged or modified retention section, generally designated 44, that is twisted relative to the plane of the body portion such that the plane of the twisted retention section is generally coincident with the plane of the twisted lead-in end 24*a* of contact portion 24. Of course, it is feasible to have the twisted portions not be coincident with one another. However, when used in conjunction with terminals having twisted lead-in ends, it is preferable to do so to maximize the amount of dielectric material between adjacent terminals in the housing as described in more detail below.

Terminal 40 is stamped and formed of conductive sheet metal material, whereby generally planar body portion 42 has opposite edges 42*a*. Twisted retention section 44 is enlarged by means of a pair of retention barbs 46 projecting transversely outwardly from the opposite edges 42*a* of body portion 42. The outer edges of retention barbs 46 are generally rounded or tapered and include sharp teeth 48 formed therein. In actual practice, enlarged, twisted retention section 44 can be simply formed by coining the body portion 42 at a prescribed point therealong to create retention barbs 46 projecting outwardly of the body portion as a result of the coined metal material thereof. As seen by the end view of FIG. 5, the end profile of each male terminal 40 is that of a pair of intersecting planes. If desired, additional secondary press fit barbs could be added along edges 42*a* adjacent terminating portion 26.

Figure 6:
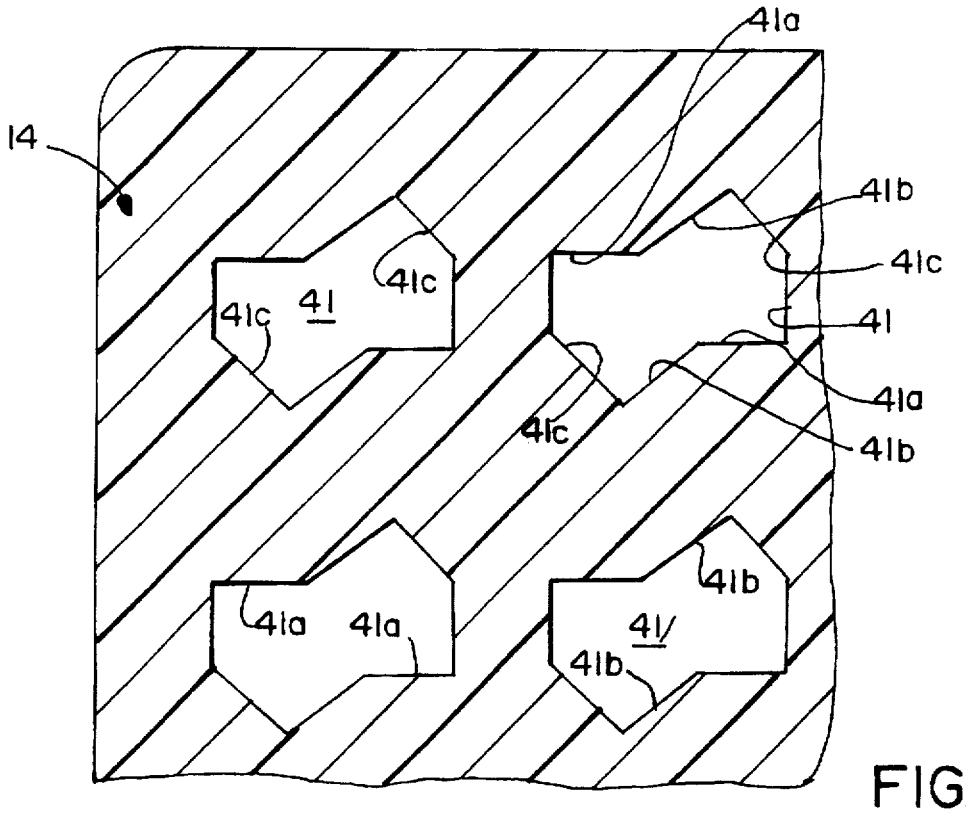
FIG. 6 is an enlarged fragmented section through some of the terminal-receiving passages of the connector housing.

Referring to FIG. 6, four terminal-receiving passages 41 are shown in cross-section. As stated above, each terminal-receiving passage extends through the dielectric housing 14 between the front and rear faces thereof. Also, in viewing the passages, it should be kept in mind that contact portion 24, body portion 42 and terminating portion 26 of each terminal 40, all are generally coplanar, with lead-in end 24*a* and retention section 44 of the terminal also being generally coplanar but twisted relative to the plane of the contact portion, body portion and terminating portion.

In particular, each terminal-receiving passage 41 has opposing side walls 41*a* for contacting and supporting opposite sides of the body portion 42 of one of the male terminals. In order to accommodate twisted lead-in end 24*a* and twisted retention section 44, each passage 41 includes an oblique portion defining oblique side walls 41*b* that effectively intersects opposing side walls 41*a* to allow for passage therethrough of twisted lead-in end 24*a* and twisted retention section 44. The oblique portion of each passage also has opposing end walls 41*c* which are effective for engaging the edges of retention barbs 46 by a press-fit. Actually, teeth 48 at the outer edges of the retention barbs establish an interference fit with the plastic material of the housing at opposing end walls 41*c* of the aperture. In other words, it can be seen that the cross section 41 is rectangular with triangular sections extending from diagonally opposed corners thereof.

Figure 7:
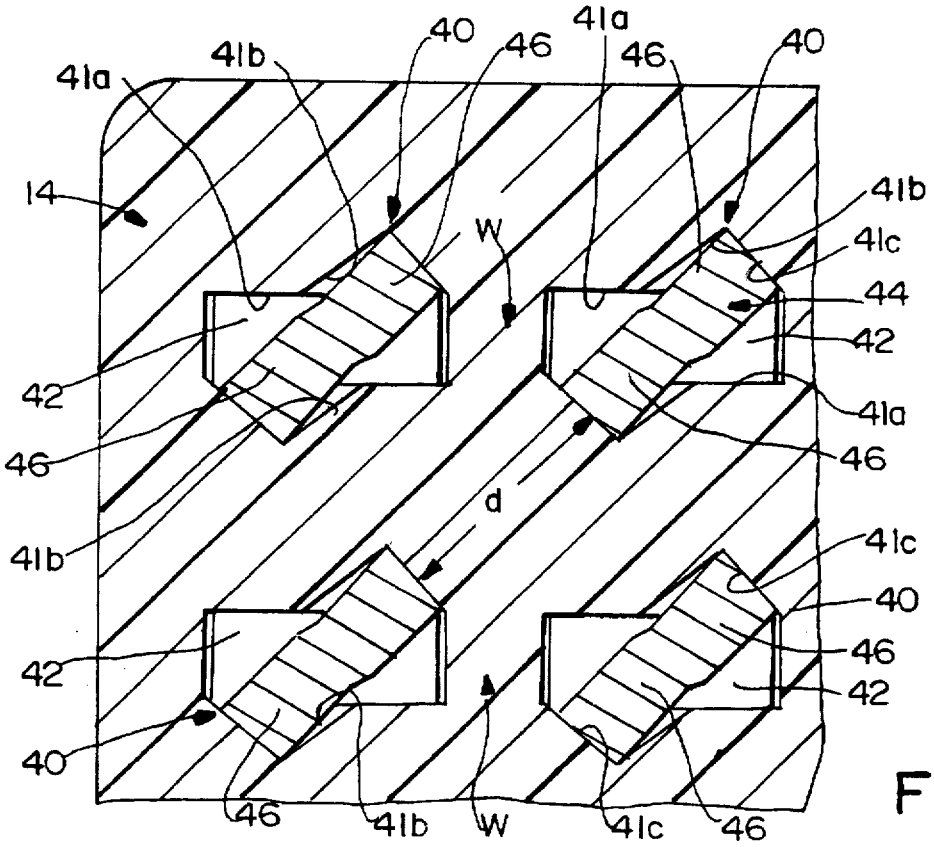
FIG. 7 is a view similar to that of FIG. 6, but with terminals received in the passages.

FIG. 7 shows four male terminals 40 having been inserted into their respective terminal-receiving passages 41. It can be seen that opposite sides of body portion 42 of each terminal are embraced by opposite side walls 41*a* of the respective passage 41. The retention section 44 of each terminal is embraced by opposite oblique walls 41*b* of the respective passage. Opposite end walls 41*c* of the oblique portion of each passage engage the edges of retention barbs 46. As the barbs are provided with teeth 48, the teeth establish an interference fit with end walls 41*c* of the oblique portion of the passage..

With the system of the present invention as described above and best shown in FIGS. 6 and 7, it readily can be seen that in any given row of terminals, the retention points of any two adjacent terminals are not directly adjacent toeach other. Because retention sections 44 are twisted out of the planes of the body portions of the terminals, adjacent retention points at the edges of the retention sections are not horizontally aligned but rather staggered between adjacent terminals along any given row of terminals. Looking at either the top row or the bottom row of terminals in FIG. 7, it can be seen that the right-hand retention point of the left-hand terminal is below the left-hand retention point of the right-hand terminal. Therefore, the retention forces between adjacent terminals are not in alignment. The result is that the terminals can be more closely spaced to each other to provide a more dense connector. This is because there is more material between adjacent terminals than if the retention points of the terminals were in alignment directly through the walls (as in the prior art), and thus there is less of a tendency to crack the plastic material in the dividing walls, generally designated "W" in FIG. 7. In essence, the distance "d" between the closest interference fit retention points that are in compression has been substantially increased.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A stamped and formed conductive male electrical terminal, comprising:

an elongated generally planar body portion;

a terminating portion extending rearwardly of the body portion;

a contact portion extending forwardly of the body portion, the contact portion having a lead-in end that is gradually twisted relative to the plane of the body portion; and the body portion including an enlarged retention section that is twisted relative to the plane of the body portion such that the plane of the twisted retention section is generally coincident with the plane of the twisted lead-in end of the contact portion.

2. The male electrical terminal of claim 1 wherein the planar body portion has opposite edges and the twisted retention section is enlarged by means of a pair of retention barbs projecting transversely outwardly from the opposite edges of the body portion.

3. The male electrical terminal of claim 2 wherein said retention barbs have tapered outer edges.

4. The male electrical terminal of claim 2 wherein said retention barbs have outer edges with teeth formed therein.

5. A stamped and formed conductive male electrical terminal, comprising:

an elongated generally planar body portion;

a contact portion extending forwardly of the body portion;

a terminating portion extending rearwardly of the body portion; and the body portion including an enlarged retention section that is twisted relative to the plane of the body portion the body portion having opposite edges and the twisted retention section being enlarged by means of a pair of retention barbs projecting transversely outwardly from the opposite edges of the body portion, said retention barbs having outer edges with teeth formed thereon.

6. The male electrical terminal of claim 5, wherein said retention barbs have generally tapered outer edges.

7. An electrical connector, comprising:

a dielectric housing;

a plurality of terminals each including an elongated planar body portion, a terminating portion extending rearwardly of the body portion, a contact portion extending forwardly of the body portion, the contact portion having a lead-in end that is gradually twisted relative to the plane of the body portion, and the body portion including an enlarged retention section that is twisted relative to the plane of the body portion such that the plane of the twisted retention section is generally coincident with the plane of the twisted lead-in end of the contact portion; and a plurality of passages in the housing for receiving the terminals, each passage including opposing side walls for supporting opposite sides of the body portion of a respective one of the terminals, and each passage including an oblique portion intersecting said opposing side walls for passage therethrough of the twisted lead-in end of the contact portion of the respective terminal, the oblique portion embracing the twisted retention section of the terminal to retain the terminal in the respective passage.

8. The electrical connector of claim 7 wherein said oblique portion of each passage has opposing end walls for engaging opposite edges of the enlarged, twisted retention section of the terminal.

9. The electrical connector of claim 8 wherein the planar body portion has opposite edges and the twisted retention section is enlarged by means of a pair of retention barbs projecting transversely outwardly from the opposite edges of the body portion, with the opposing end walls of the oblique portion of the passage engaging edges of the retention barbs.

10. The electrical connector of claim 9 wherein said retention barbs have outer edges with teeth formed therein.

11. The electrical connector of claim 7 wherein a lateral cross-section through one of said passages is generally rectangular with a pair of triangular sections at diagonally opposed corners thereof.

12. An electrical connector, comprising:

a dielectric housing;

a plurality of stamped and formed conductive terminals, each terminal including an elongated generally planar body portion, a contact portion extending forwardly of the body portion, a terminating portion extending rearwardly of the body portion, and the body portion including a retention section that is twisted relative to the plane of the body portion; and a plurality of passages in the housing for receiving the terminals, each passage including opposing side walls for supporting opposite sides of the planar portion of a respective one of the terminals, and each passage including an oblique portion intersecting said opposing side walls for receiving the twisted retention section of the respective terminal.

13. The electrical connector of claim 12 wherein said oblique portion of each passage has opposing end walls for engaging opposite edges of the twisted retention section of the terminal.

14. The electrical connector of claim 13 wherein the planar body portion has opposite edges and the twisted retention section is enlarged by means of a pair of retention barbs projecting transversely outwardly from the opposite edges of the body portion, with opposing end walls of the oblique portion of the passage engaging edges of the retention barbs.

15. The electrical connector of claim 14 wherein said retention barbs have outer edges with teeth formed therein.

16. The electrical connector of claim 15 wherein a lateral cross-section through one of said passages is generally rectangular with a pair of triangular sections at diagonally opposed corners thereof.

17. The electrical connector of claim 12 wherein a lateral cross-section through one of said passages is generally rectangular with a pair of triangular sections at diagonally opposed corners thereof.

* * * * *